US009222329B2

(12) United States Patent
McGuire et al.

(10) Patent No.: US 9,222,329 B2
(45) **Date of Patent: *Dec. 29, 2015**

(54) LOW PROFILE, HIGH CAPACITY BALL INJECTOR

(71) Applicant: OIL STATES ENERGY SERVICES, L.L.C., Houston, TX (US)

(72) Inventors: Bob McGuire, Meridian, OK (US); Danny Lee Artherholt, Asher, OK (US)

(73) Assignee: Oil States Energy Services, L.L.C., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/519,398

(22) Filed: Oct. 21, 2014

(65) Prior Publication Data

US 2015/0034296 A1 Feb. 5, 2015

Related U.S. Application Data

(62) Division of application No. 12/974,615, filed on Dec. 21, 2010, now Pat. No. 8,869,882.

(51) Int. Cl.

| | |
|---|---|
| ***E21B 33/05*** | (2006.01) |
| ***E21B 33/068*** | (2006.01) |
| ***E21B 43/26*** | (2006.01) |
| ***B65D 83/04*** | (2006.01) |
| ***E21B 41/00*** | (2006.01) |

(52) U.S. Cl.

CPC ..... *E21B 33/068* (2013.01); *B65D 83/0409* (2013.01); *E21B 33/05* (2013.01); *E21B 41/00* (2013.01); *E21B 43/26* (2013.01); *Y10T 137/4891* (2015.04)

(58) Field of Classification Search

CPC ..... E21B 33/068; E21B 33/05; E21B 33/16; E21B 33/14; E21B 43/261; F16L 55/46; G01F 25/0015

See application file for complete search history.

(56) References Cited

U.S. PATENT DOCUMENTS

| | | | |
|---|---|---|---|
| 2,961,045 | A | 11/1960 | Stonger et al. |
| 2,961,046 | A | 11/1960 | Moeller et al. |
| 3,000,028 | A | 9/1961 | Buie et al. |
| 3,011,196 | A | 12/1961 | Glover |
| 3,028,996 | A | 4/1962 | Ellett |
| 3,889,708 | A | 6/1975 | Chronister et al. |
| 3,911,724 | A | 10/1975 | Grove et al. |
| 4,111,334 | A | 9/1978 | Winn, Jr. et al. |
| 4,132,243 | A | 1/1979 | Kuus |
| 4,134,288 | A | 1/1979 | Kim |
| 4,268,932 | A | 5/1981 | Hogan |
| 4,359,797 | A | 11/1982 | Banks |
| 6,302,199 | B1 | 10/2001 | Hawkins et al. |
| 6,575,238 | B1 | 6/2003 | Yokley |
| 2003/0155114 | A1 | 8/2003 | Pedersen et al. |
| 2005/0039925 | A1 | 2/2005 | Connell |
| 2007/0068679 | A1 | 3/2007 | Robichaux et al. |
| 2008/0087414 | A1 | 4/2008 | Robichaux et al. |
| 2008/0223587 | A1 | 9/2008 | Cherewyk |

FOREIGN PATENT DOCUMENTS

| | | |
|---|---|---|
| CA | 2703426 | 11/2010 |

*Primary Examiner* — David Andrews
*Assistant Examiner* — Wei Wang
(74) *Attorney, Agent, or Firm* — Nelson Mullins Riley & Scarborough, LLP

(57) ABSTRACT

An injector spool supports a plurality of ball injector assemblies having respective ball cartridges adapted to load one frac ball at a time into a ball chamber of a ball launcher of the respective ball injector assemblies to provide a low profile, high capacity ball injector.

20 Claims, 10 Drawing Sheets

LOW PROFILE, HIGH CAPACITY BALL INJECTOR

RELATED APPLICATIONS

This is a division of U.S. patent application Ser. No. 12/974,615 filed Dec. 21, 2010.

FIELD OF THE INVENTION

This invention relates in general to equipment used for the purpose of well completion, re-completion or workover, and, in particular, to ball injectors used to inject or drop balls into a fluid stream pumped into a subterranean well during well completion, re-completion or workover operations.

BACKGROUND OF THE INVENTION

The use of balls to control fluid flow in a subterranean well is well known. The balls are generally dropped or injected into a fluid stream being pumped into the well. This can be accomplished manually, but the manual process is time consuming and requires that workmen be in close proximity to highly pressurized fluid lines, which is a safety hazard. Consequently, ball droppers or injectors have been invented to permit faster and safer operation.

As is well understood in the art, multi-stage well stimulation operations often require that balls of different diameters be sequentially injected into the well in a predetermined size order that is graduated from a smallest ball to a largest ball. While ball injectors are available that can inject single balls in any order, such injectors require that a plurality of injector spools be vertically stacked to achieve the required availability of balls of different diameters. The stacking of injector spools increases weight on the wellhead and raises working height, both of which are undesirable.

There therefore exists a need for a low profile high capacity ball injector for use during well completion, re-completion or workover operations.

SUMMARY OF THE INVENTION

It is therefore an object of the invention to provide a low profile high capacity ball injector for use during well completion, re-completion or workover operations.

The invention therefore provides a ball injector, comprising: an injector spool having a top end, a bottom end and an axial passage that extends from the top end to the bottom end; and at least two independently operated ball injector assemblies respectively connected to a radial port through a sidewall of the injector spool, each ball injector assembly supporting a ball cartridge that accommodates a plurality of frac balls and comprises a ball launcher that is reciprocated by a ball launcher drive from a ball load position in which a ball is loaded from the ball cartridge into a ball chamber of the ball injector, to a ball launch position in which the ball is released from the ball chamber into the axial passage.

The invention further provides a ball injector assembly, comprising: a ball cartridge that accommodates a plurality of frac balls; a ball launcher having a ball chamber sized to receive a one of the frac balls; and a ball launcher drive that reciprocates the ball launcher from a ball load position in which the one of the frac balls is loaded into the ball chamber to a ball launch position in which the one of the frac balls is released from the ball chamber.

The invention yet further provides a ball injector adapted to be mounted to a top end of a frac head, comprising a ball injector spool having a plurality of ball injector mechanisms that respectively support a ball cartridge adapted to store a plurality of frac balls, each ball injector mechanism having a ball launcher reciprocated by a ball launcher drive from a ball load position in which a one of the frac balls is loaded from the ball cartridge into a ball chamber of the ball launcher and a ball launch position in which the one of the frac balls is released from the ball chamber into an axial passage through the ball injector spool.

BRIEF DESCRIPTION OF THE DRAWINGS

Having thus generally described the nature of the invention, reference will now be made to the accompanying drawings, in which:

FIGS. 4*a*-4*d* are schematic diagrams of a ball injector of the injector assembly shown in FIG. 3, wherein FIG. 4*a* is a side elevational view of the ball injector; FIG. 4*b* is a top plan view of the ball injector; FIG. 4*c* is a rear end view of the ball injector; and, FIG. 4*d* is a front end view of the ball injector;

FIGS. 7*a*-7*d* are schematic diagrams of a ball injector of the injector assembly shown in FIG. 6, wherein FIG. 7*a* is a side elevational view of the ball injector; FIG. 7*b* is a top plan view of the ball injector; FIG. 7*c* is a rear end view of the ball injector; and, FIG. 7*d* is a front end view of the ball injector;

DETAILED DESCRIPTION OF THE PREFERRED EMBODIMENTS

The invention provides a low profile high capacity ball injector for injecting balls of any required diameter into a fluid stream being pumped into a subterranean well. High capacity ball cartridges ensure that an adequate supply of balls of any required diameter is available for even the most complex well completion, recompletion or workover project.

Figure 1:
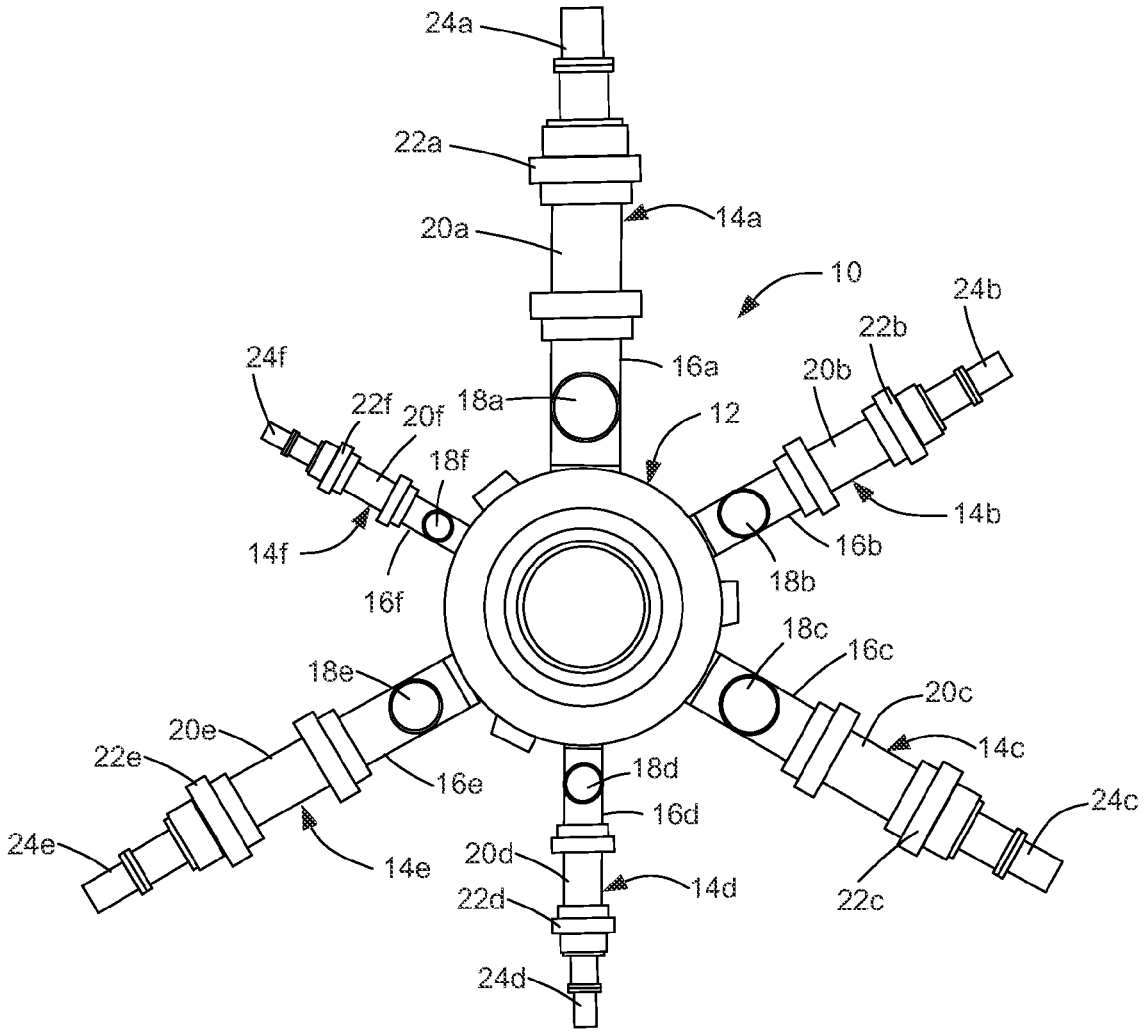
FIG. 1 is a schematic top plan view of one embodiment of a ball injector in accordance with the invention.

FIG. 1 is a schematic top plan view of a ball injector 10 in accordance with one embodiment of the invention. The ball injector 10 includes an injector spool 12 that supports a plurality of ball injector assemblies 14. In this embodiment the ball injector includes six ball injector assemblies, 14*a*-14*f*. Each ball injector assembly 14 includes a respective cartridge section 16*a*-16*f* that supports a ball cartridge 18*a*-18*f*, seen in side elevation in FIG. 2. Each ball injector assembly 14 further includes a ball launch section 20*a*-20*f*, a pressure seal section 22*a*-22*f*, and a drive section 24*a*-24*f*. In this embodiment, ball launch drive power is provided by motors, which may be hydraulic, pneumatic or electric motors, as will be explained below with reference to FIGS. 3-5. However, in another embodiment the ball launch drive power is provided by hydraulic or pneumatic cylinders, as will be explained below with reference to FIGS. 6-9.

Figure 2:
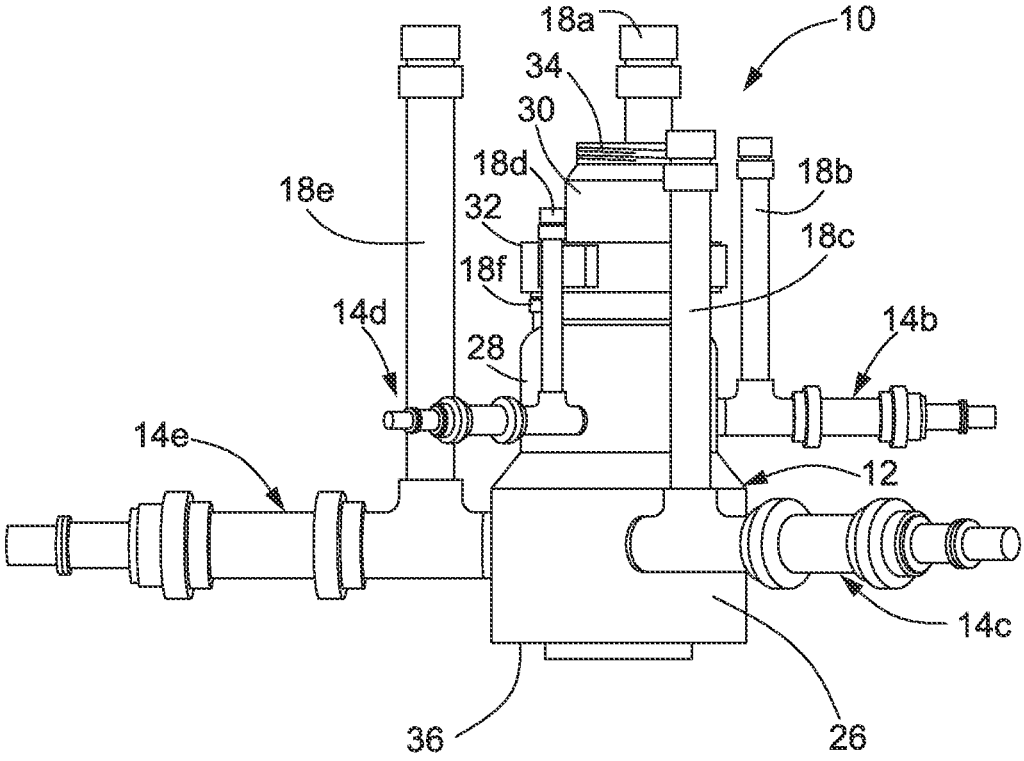
FIG. 2 is a schematic side view of the ball injector shown in FIG. 1.

FIG. 2 is a schematic side view of the ball injector 10 shown in FIG. 1. The injector spool 12 includes a lower section 26 and an upper section 28. The upper section 28 terminates in a threaded union connector 29 (see FIG. 3), to which a frac iron adapter 30 is connected by a wing nut 32. In this embodiment the frac iron adapter 30 terminates on a top end in a threaded neck 34, which supports the connection of, for example, a chicksan with 1502 unions, which are well known in the art. As will be understood by those skilled in the art, the top end of the injector spool 12 and the bottom end of the frac iron adapter 30 may be also mated using a bolted flange or a stud pad. The connection to the chicksan permits well stimulation fluids to be pumped through the injector spool 12, as will be explained below in more detail with reference to FIG. 10. In this embodiment of the injector spool 12, the lower section 26 terminates on a bottom end in a stud pad 36, likewise well known in the art. It should be understood, however, that the lower section 26 may terminate in either of a bolted flange or a threaded union connector.

The bottom section 26 and the top section 28 respectively support three ball injector assemblies 14. The ball injector assemblies 14 that handle the larger diameter balls, for example 2¼-4½ inch balls, are mounted to a sidewall of the lower section 26 in alignment with radial bores through the sidewall of the lower section 26, as will be explained below with reference to FIG. 3. The ball injector assemblies 14 that handle the smaller diameter balls, for example ¾-2 inch balls, are mounted to a sidewall of the upper section 28 in alignment with radial bores through the sidewall of the upper section 28, as will be explained below with reference to FIGS. 6-9. The three radial bores in the sidewall of the lower section 26 are offset by 120° with respect of one to the other, and the three radial bores in the sidewall of the upper section 28 are offset by 120° with respect of one to the other, and 60° with respect to respective adjacent radial bores in the lower section 26. However, the number, the arrangement and the spacing of the ball injector assemblies 14 on the injector spool is a matter of design choice and three injector assemblies 14 on each section is shown by way of example only.

Figure 3:
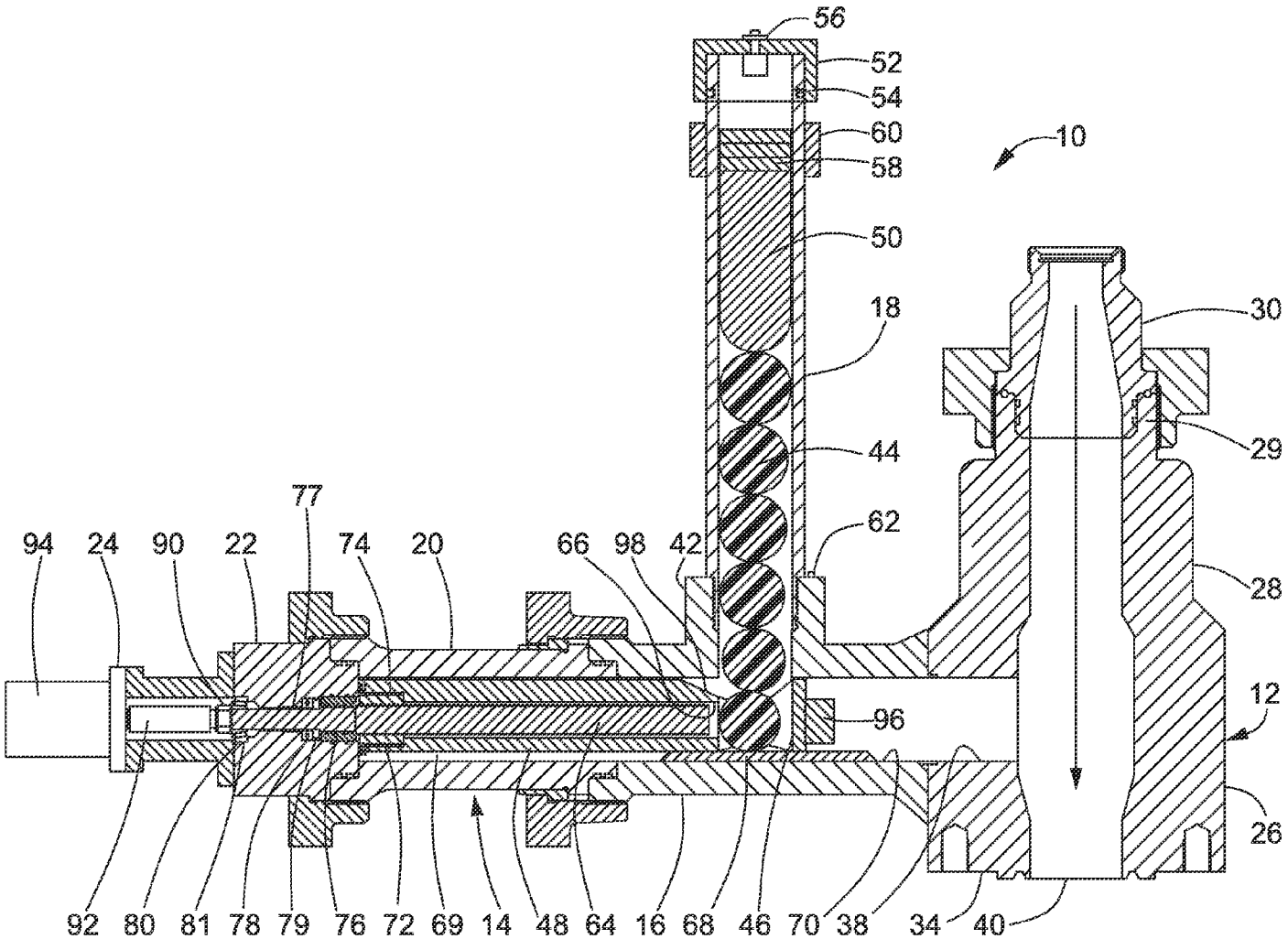
FIG. 3 is a schematic cross-sectional view of an injector spool and one injector assembly of the embodiment shown in FIG. 1.

FIG. 3 is a schematic cross-sectional view of the injector spool 12 and one ball injector assembly 14 of the embodiment of the ball injector 10 shown in FIG. 1. The cartridge section 16 is welded, or threadedly connected, to the lower sidewall 26 in alignment with a radial bore 38 that communicates with an axial passage 40 of the injector spool 12. The ball cartridge 18 is threadedly connected to a ball cartridge port 42 in a top of the cartridge section 16. In this embodiment, the ball cartridge port 42 supports the ball cartridge 18 in axial alignment with the injector spool 12, though this orientation is not essential. The ball cartridge 18 stores a plurality of commercially available frac balls 44, typically phenolic resin frac balls of a composition known in the art. The frac balls 44 are urged into a ball chamber 46 of a ball launcher 48 by a ball chase 50. In one embodiment the ball chase 50 is made of stainless steel. A ball cartridge cover 52 provided with high pressure seals 54 seals a top end of the ball cartridge 18.

As understood by those skilled in the art, it is advantageous to have confirmation when a frac ball 44 has been injected. Consequently, it is advantageous to provide a system that displays a relative position of the ball chase 50 within the ball cartridge 18. In accordance with one embodiment of the invention, the system that displays the relative position of the ball chase 50 within the ball cartridge 18 is a sonic transducer 56, an output of which is used to create a display on a ball injector control console (not shown). The display may provide a simple indication of a distance, for example in inches or centimeters, from a bottom of the sonic transducer to a top of the ball chase 50. Alternatively, a programmable circuit can translate the distance into a number of balls remaining in the ball cartridge using a simple algorithm within the knowledge of one skilled in the art.

In accordance with another embodiment of the invention, the system that displays the relative position of the ball chase 50 within the ball cartridge 18 is a laser range finder 62. In accordance with this embodiment, the ball cartridge 18 is constructed from a high tensile strength nonmagnetic material, such as copper beryllium, or the like. A rare earth magnet pack 58 secured to a top end of the ball chase 50 strongly attracts an external follower sleeve 60 sized so that a bottom edge thereof roughly coincides with the top end of the ball chase 50. The external follower sleeve 60 may be a magnetic material, such as steel, or contain embedded magnets oriented to be attracted to the magnet pack 58. The laser range finder 62 is mounted to a top of the ball cartridge port 42 and computes a distance to a bottom edge of the external follower sleeve 60. The distance may be displayed as a number of inches or centimeters, or translated into a ball count, that is displayed by on a display (not shown) of a control console, as explained above.

If the sonic transducer is used to track the position of the ball chase 50, the top end of the ball chase 50 may be drilled and tapped with an acme thread, or the like, to accept a compatibly threaded end of a lifter rod (not shown) to permit the ball chase 50 to be removed when there is no fluid pressure on the injector spool 12, so that the ball cartridge 18 can be recharged with frac balls 44. If the magnet pack 58 is secured to the top of the ball chase 50, a magnetic lifting rod (not shown) may be used to lift the ball chase 50 out of the ball cartridge 18 for the same purpose, or a bore may be drilled through the magnet pack 58 to permit a threaded lifting rod to be used, as described above.

Figure 4C:
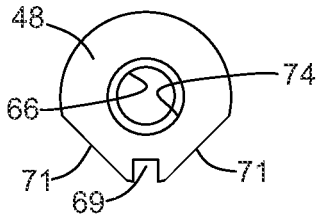
Figure 5:
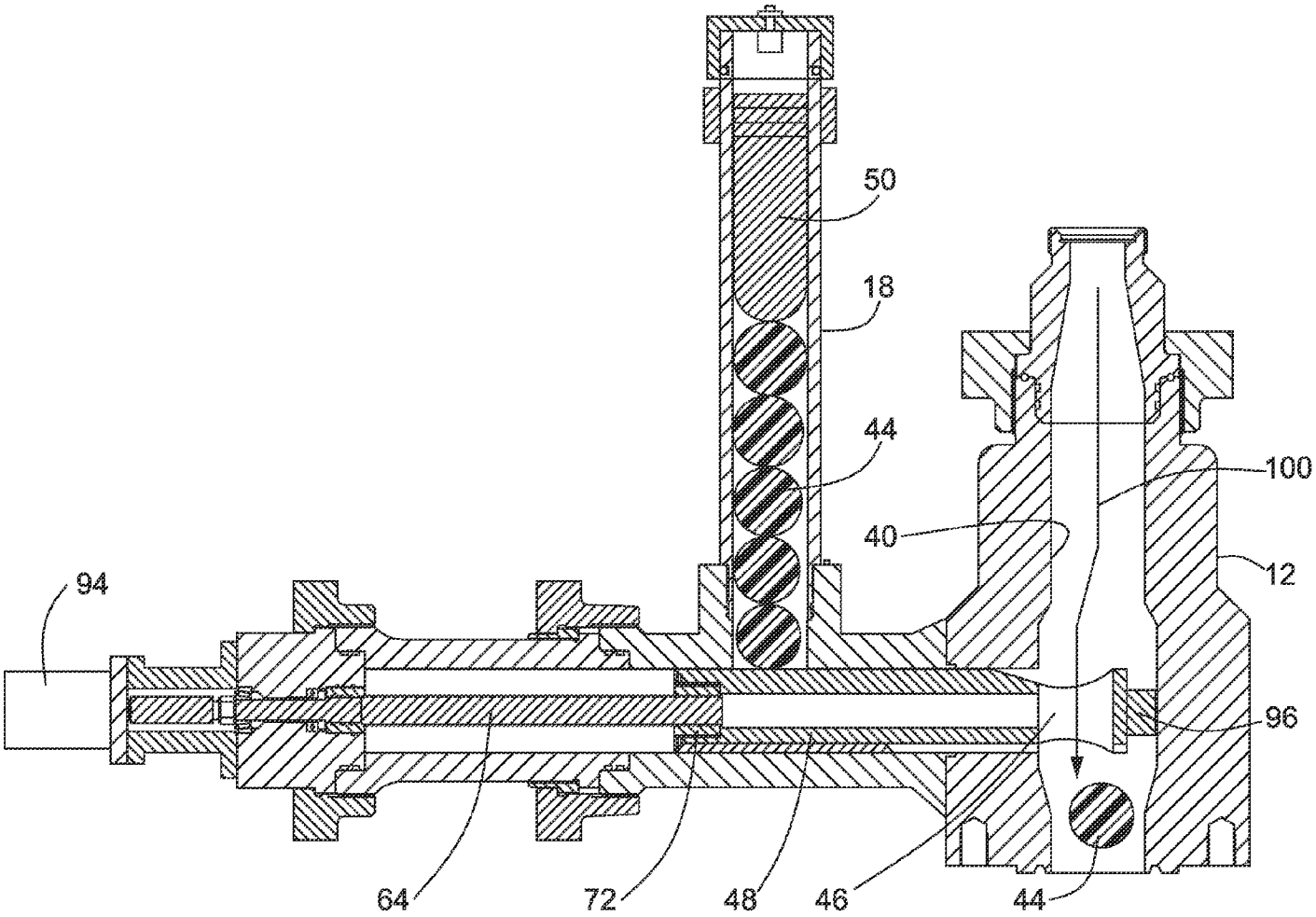
FIG. 5 is a schematic cross-sectional view of the injector assembly shown in FIG. 3 launching a ball into a fluid stream pumped through the injector spool.

The ball launcher 48 is reciprocated from a ball load position shown in FIG. 3 to a ball launch position shown in FIG. 5 by a ball launcher drive. In one embodiment the ball launcher drive, as shown in FIG. 3, is a threaded drive rod 64, which extends into an axial bore 66 that runs from a rear end of the ball launcher 48 to a rear side of the ball chamber 46. A guide key 68 received in a key way 69 that runs a full length of a bottom of the ball launcher 48 (see FIG. 4*c*) prevents the ball launcher 48 from rotating within a cylindrical bore 70 that extends from an outer end of the ball launch section 20 to an inner end of the cartridge section 16. The guide key 68 is machined into, affixed to, or built up on a bottom of the cylindrical bore 70 in the cartridge section 16 and supports the frac ball 44 in the ball chamber 46 when the ball launcher 48 is in the ball load position.

The threads on the drive rod 64 are engaged by a compatibly threaded drive sleeve 72 immovably captured in a drive sleeve bore 74 in the rear end of the ball launcher 48. Rotation of the drive rod 64 translates to linear movement of the ball launcher 48 due to the compatible threads on the drive sleeve 72. A high pressure seal pack 76 prevents well and stimulation fluid pressure from escaping around the drive rod 64. The drive rod 64 is radially stabilized by a needle bearing 77 and axially stabilized a thrust bearing 78 that rides on a bushing 79 which abuts a step in the drive rod 64, and both axially and radially stabilized by a tapered roller bearing 80 received in a tapered bearing cage 81. A lock nut 90 threadedly engages an outer end of the drive rod 64 and locks the bearings 78, 80 in place. A drive shaft 92 connected to the outer end of the drive rod 64 and an output shaft of a motor 94 rotates the drive rod 64 in a direct relation to rotation of the output shaft of the motor 94. The motor 94 may be a hydraulic, pneumatic or an electric motor. A travel limiter 96 on an inner end of the ball launcher 48 ensures that the drive rod 64 cannot be disengaged from the drive sleeve 72, as will be explained below with reference to FIG. 5. As the ball launcher 48 is moved forward by the motor 94 from the ball load position to the ball launch position shown in FIG. 5, a ball shunt ramp 98 forces all other balls 44 in the ball cartridge 18 upward to ensure that a frac ball resting on the frac ball 44 in the ball chamber 46 is not damaged as the ball launcher 48 is driven past the ball cartridge 18.

Figure 4A:
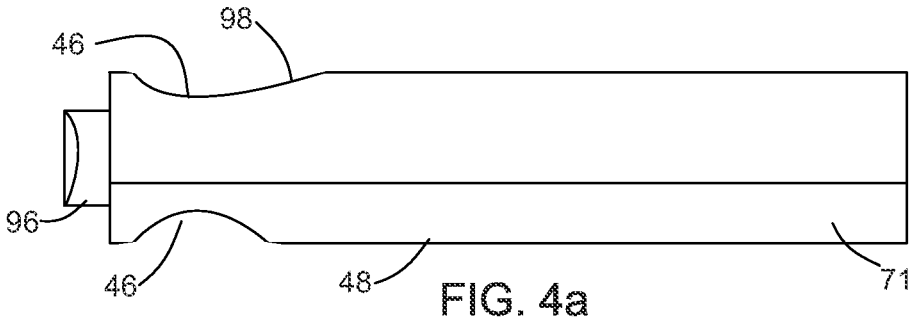
Figure 4B:
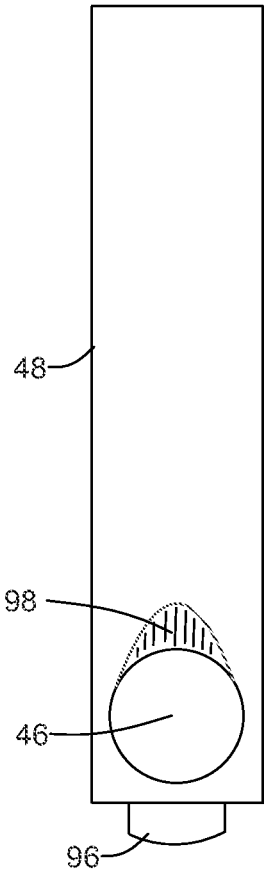
Figure 4D:
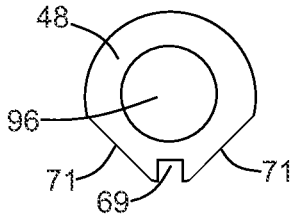

FIGS. 4*a*-4*d* are schematic diagrams of the ball launcher 48 of the injector assembly 14 shown in FIG. 3. FIG. 4*a* is a side elevational view of the ball launcher 48. As can be seen, the ball chamber 46 extends completely through the ball launcher 48, whereas the ball shunt ramp 98 is only on the top side of the ball launcher 48, as can also be seen in FIG. 4*b* which is a top plan view of the ball launcher 48. FIG. 4*c* is a rear end view of the ball launcher 48 and FIG. 4*d* is a front end view of the ball launcher 48. As seen in FIG. 4*c*, the axial bore 66 and the drive sleeve bore 74 are concentric. As seen in FIGS. 4*c* and 4*d*, the key way 69 extends a full length of the ball launcher 48. Longitudinal flats 71 milled on each side of the key way 69 provide fluid passages to permit well stimulation fluid to flow around the ball launcher 48 as it is reciprocated from the ball load position to the ball launch position. As also seen in FIG. 4*d*, in this embodiment the travel limiter 96 is a cylindrical boss having a front face that is contoured to mate with an inner wall of the axial passage 40 of the injector spool 12 shown in FIG. 3. However, the shape of the travel limiter 96 is a matter of design choice.

FIG. 5 is a schematic cross-sectional view of the injector spool 12 and the injector assembly 14 shown in FIG. 3 in the process of launching a ball 44 into a fluid stream 100 pumped through the injector spool 12. As shown in FIG. 5, when the ball launcher 48 enters the axial passage 40 of the injector spool 12 the fluid stream 100 is being pumped through the injector spool 12 and a portion of the fluid stream 100 flows through the ball chamber 46. This applies downward pressure on the frac ball 44. As soon as the ball launcher has moved far enough into the axial passage 40, the frac ball 44 is forced by gravity and the pressure of the fluid flow 100 down through the bottom of the ball chamber 46. In accordance with one embodiment of the invention, when the travel limiter 96 contacts a sidewall of the axial passage a resulting drive fluid pressure buildup due to resistance to further rotation of the drive shaft 64 causes a pressure-activated switch (not shown) to automatically reverse the flow of drive fluid to the motor 94, which reverses the rotation of the motor 94 and retracts the ball launcher 48 to the ball load position shown in FIG. 3. In the ball load position, a next ball 44 in the ball cartridge 18 is urged into the ball chamber 46 by the ball chase 50. The same pressure-activated switch stops the flow of drive fluid to the motor 94 when the ball launcher 48 has returned to the ball load position. Of course the motor 94 can also be controlled manually by monitoring a drive fluid pressure gauge that indicates a pressure of the drive fluid being supplied to the motor 94, for example. The position of the ball chase 50, determined using one of the apparatus described above with reference to FIG. 3, gives a positive indication of whether the ball launcher 48 has been returned to the ball load position after a ball has been successfully injected into the well.

Figure 6:
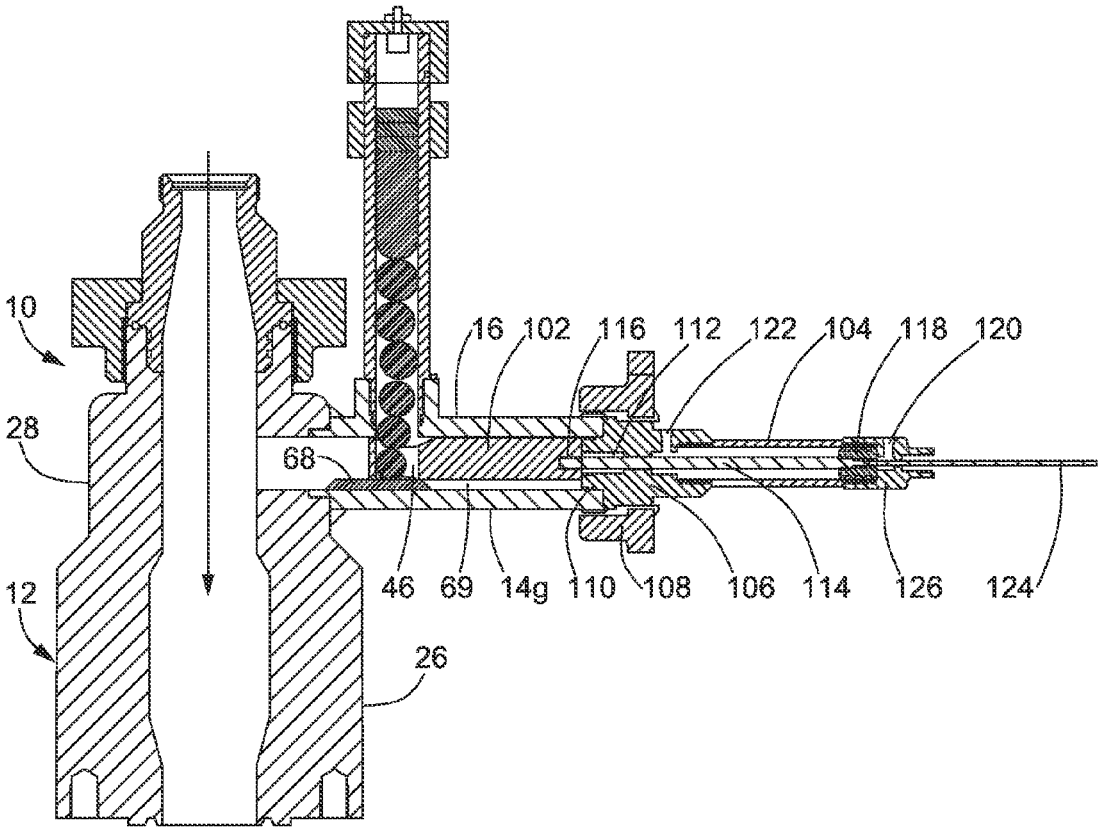
FIG. 6 is a schematic cross-sectional view of the injector spool and one injector assembly in accordance with another embodiment of the invention.

FIG. 6 is a schematic cross-sectional view of the injector spool 12 and one injector assembly 14*g* in accordance with another embodiment of the invention. The injector assembly 14*g* is identical to the injector assembly 14 described above with reference to FIG. 3 with the exceptions of the drive unit and minor differences in a ball launcher 102. The ball launcher 102 is reciprocated from the ball load to the ball launch position by a hydraulic or pneumatic cylinder 104. The hydraulic or pneumatic cylinder 104 has an inner end 106 connected to the cartridge section 16 by a wing nut 108. O-ring seals 110 inhibit well stimulation fluid from escaping to atmosphere around the inner end 106. A high pressure seal pack 112 inhibits well pressure from entering the cylinder 104, and prevents leakage around a piston rod 114 that is affixed to a rear end of the ball launcher 102. In this embodiment, the piston rod 114 threadedly engages a threaded bore 116 in a rear end of the ball launcher 102. A piston 118 is reciprocated within the cylinder 104 by fluid injected (and drained, as appropriate) through respective ports 120, 122. A cylinder position indicator rod 124 connected to a rear side of the piston 118 provides a visual indication of a position of the piston 118. The cylinder position indicator rod 124 extends through fluid seals (not shown) supported by a cylinder end cap 126.

Figure 7A:
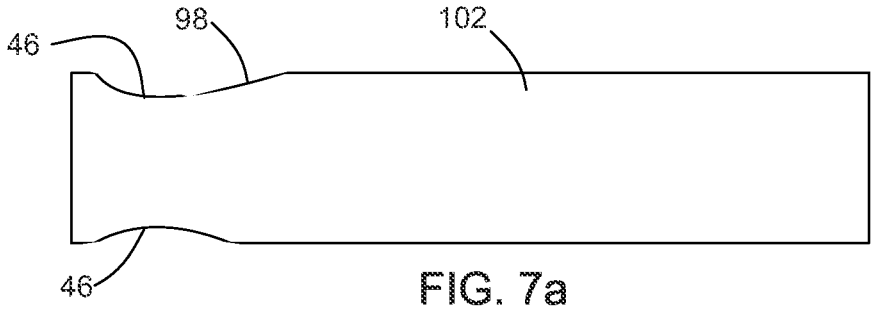
Figure 7C:
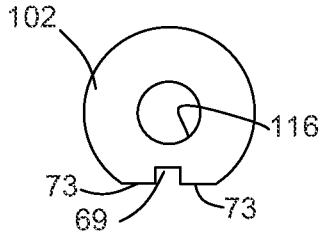
Figure 7B:
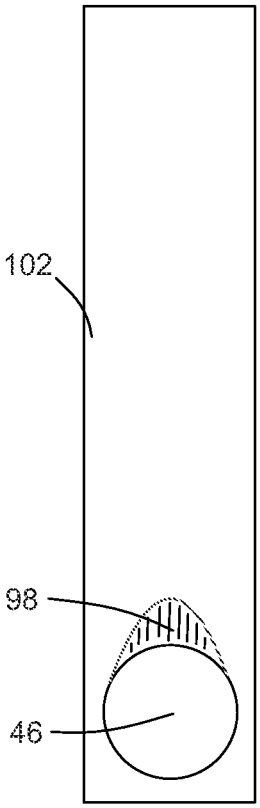
Figure 7D:
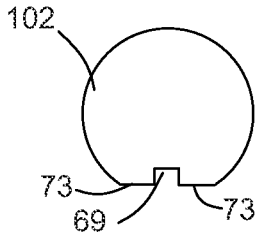

FIGS. 7*a*-7*d* are schematic diagrams of the ball launcher 102 of the injector assembly 14*g* shown in FIG. 6. FIG. 7*a* is a side elevational view of the ball launcher 102. As can be seen, the ball chamber 46 extends completely through the ball launcher 102, whereas the ball shunt ramp 98 is only on the top side of the ball launcher 48, as can also be seen in FIG. 7*b* which is a top plan view of the ball launcher 102. FIG. 7*c* is a rear end view of the ball launcher 102 and FIG. 7*d* is a front end view of the ball launcher 102. The threaded bore 116 that accepts the piston rod 114 (FIG. 6) can be seen in FIG. 7*c*. As seen in FIGS. 7*c* and 7*d*, the key way 69 extends a full length of the ball launcher 102. Longitudinal flats 73 milled on each side of the key way 69 provide fluid passages to permit well stimulation fluid to flow around the ball launcher 102 as it is reciprocated from the ball load position to the ball launch position.

Figure 8:
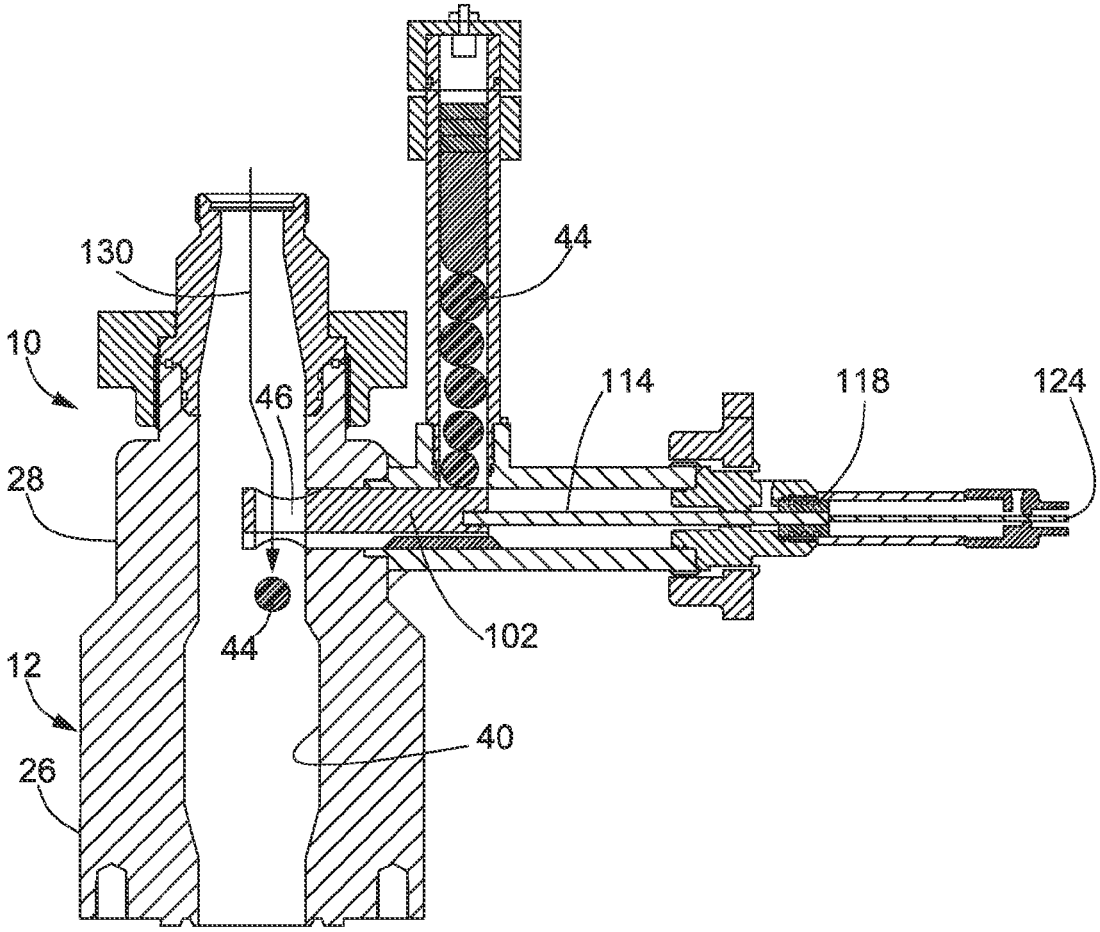
FIG. 8 is a schematic cross-sectional view of the injector assembly shown in FIG. 6 launching a ball into a fluid stream pumped through the injector spool.

FIG. 8 is a schematic cross-sectional view of the injector spool 12 and the ball launcher 102 shown in FIG. 6 in the process of launching a frac ball 44 into a fluid stream 130 pumped through the injector spool 12. When the piston 118 is at the end of its stroke as shown, the piston rod 114 is fully extended and the ball chamber 46 in the ball launcher 102 is inside the axial passage 40 of the injector spool 12. Consequently, the fluid stream 130 flows through the ball chamber 46 and carries the frac ball 44 downwardly through the axial passage 40. The cylinder position indicator rod 124 visually indicates that the ball launcher 102 is in the ball launch position.

Figure 9:
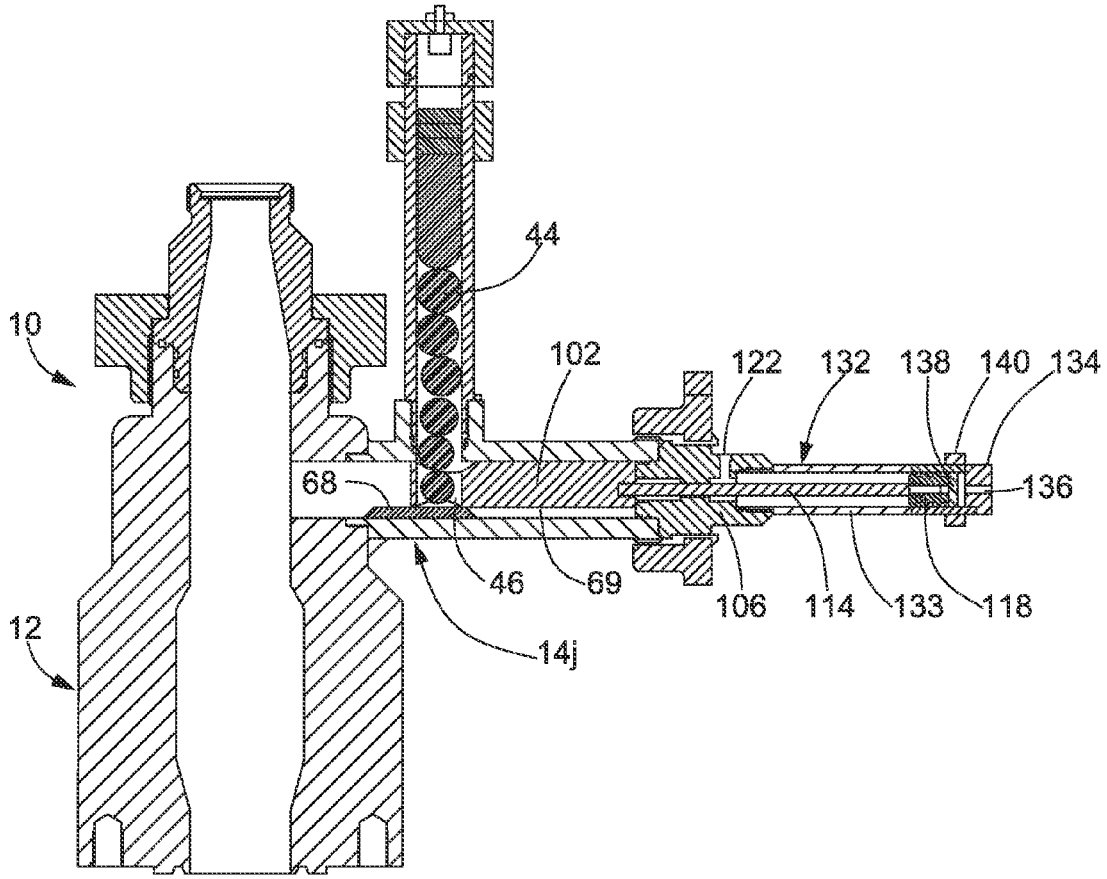
FIG. 9 is a schematic cross-sectional view of the injector spool and one injector assembly in accordance with yet another embodiment of the invention.

FIG. 9 is a schematic cross-sectional view of the injector spool 12 and one injector assembly 14*j* in accordance with yet another embodiment of the invention. The injector assembly 14*j* is identical to the injector assembly 14*g* described above with reference to FIGS. 6-8, with an exception that a hydraulic or pneumatic cylinder 132 of the injector assembly 14*j* does not include the cylinder position indicator rod 124 described above. Rather, the cylinder 132 of the injector assembly 14*j* has a non-magnetic cylinder wall 133, made from an aluminum alloy, or the like. A cylinder cap 134 on an outer end of the cylinder 132 includes a fluid injection port 136 through which fluid is injected, or drained, as required using a fluid line (not shown). A magnet or magnet assembly 138 is affixed to an outer end of the cylinder 118. A position indicator sleeve 138 has an inner diameter that permits the position indicator sleeve 138 to be easily reciprocated over the cylinder wall 133. The position indicator sleeve 140 is magnetically captured by the magnet 140. Consequently, the position indicator sleeve 140 continuously follows any movement of the piston 118, and provides a visual indication of a position of the piston 118, to permit an operator to visually follow movement of the piston 118.

Figure 10:
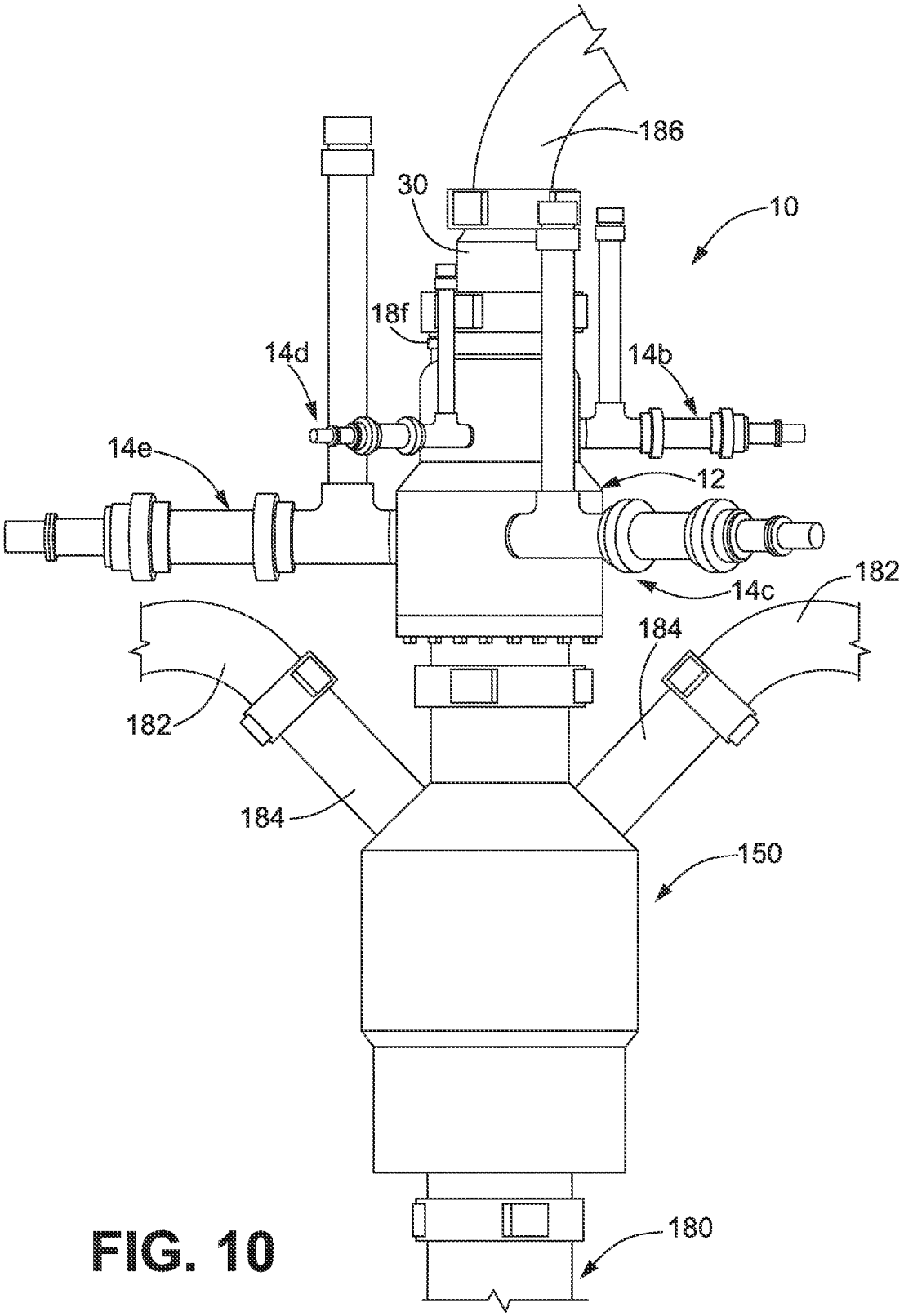
FIG. 10 is a schematic diagram of the ball injector shown in FIG. 2 mounted to a frac head.

FIG. 10 is a schematic diagram of the ball injector 10 shown in FIG. 2 mounted to a frac head 150. The frac head 150, which may be a frac head of any known configuration, is mounted, for example, to a wellhead with a master control valve 180 in a manner known in the art. Frac irons 182, 1502 or 1002 frac iron, for example, are connected to well stimulation fluid injection ports 184 of the frac head. In this example, two well stimulation fluid injection ports 184 are shown for the sake of illustration. However, many frac heads are equipped with at least 4 well stimulation fluid injection ports 184. 1502 or 1002 frac iron 186 is also connected to the frac iron adapter 30, which is mounted to the top of the injector spool 12. During a well completion, recompletion or workover project well stimulation fluid is pumped by high pressure pumps (not shown) through the 1502 frac irons 182 and 186 using procedures well known in the art.

The embodiments of the invention described above are only intended to be exemplary of the ball injector 10 in accordance with the invention, and not a complete description of every possible configuration. The scope of the invention is therefore intended to be limited solely by the scope of the appended claims.

We claim:

1. A ball injector, comprising:

an injector spool having a top end, a bottom end and an axial passage that extends from the top end to the bottom end;

at least two independently operated ball injector assemblies respectively connected to respective radial ports through a sidewall of the injector spool, each ball injector assembly supporting a ball cartridge that accommodates a plurality of frac balls and comprises a ball launcher with a ball chamber that extends completely through the ball launcher; the ball launcher being reciprocated by a ball launcher drive comprising a cylinder having a piston with a piston rod affixed to a rear end of the ball launcher, the ball launcher drive moving the ball launcher from a ball load position in which a frac ball is loaded from the ball cartridge into the ball chamber, to the ball launch position in which the frac ball is released from the ball chamber after the ball launcher has been moved far enough into the axial passage by the ball launcher drive that the frac ball moves down through a bottom of the ball chamber; and a guide key received in a key way that runs a full length of a bottom of the ball launcher to prevent the ball launcher from rotating within a cylindrical bore that extends from an outer end of a ball launch section of the respective ball injector assemblies to an inner end of a cartridge section of the respective ball injector assemblies.

2. The ball injector as claimed in claim 1 wherein the ball launcher drive comprises a hydraulic or a pneumatic cylinder having the piston with the piston rod affixed to the rear end of the ball launcher.

3. The ball injector as claimed in claim 2 wherein the ball launcher drive further comprises a cylinder position indicator rod connected to a rear side of the piston and extending through a rear end of the cylinder to provide a visual indication of a position of the piston within the cylinder.

4. The ball injector as claimed in claim 2 wherein the cylinder comprises a cylinder wall of a non-magnetic alloy and further comprises a magnet affixed to a rear side of the piston and a position indicator sleeve that has an inner diameter that permits the position indicator sleeve to be reciprocated over the cylinder wall to provide a visual indication of a position of the piston within the cylinder.

5. The ball injector as claimed in claim 1 wherein the guide key is on a bottom of the cylindrical bore in the cartridge section and supports the frac ball in the ball chamber when the ball launcher is in the ball load position.

6. The ball injector as claimed in claim 1 further comprising longitudinal flats milled on each side of the key way to provide fluid passages that permit well stimulation fluid to flow around the ball launcher as the ball launcher is reciprocated from the ball load position to the ball launch position.

7. The ball injector as claimed in claim 1 wherein the ball cartridge comprises a ball chase having a top end that urges the frac balls into the ball chamber of the ball launcher, the ball chase being adapted to be engaged by a lifting rod to lift the ball chase from the ball cartridge so that the ball cartridge can be recharged with frac balls.

8. The ball injector as claimed in claim 7 wherein the ball cartridge comprises a cylinder of a non-magnetic alloy with a high tensile strength.

9. The ball injector as claimed in claim 8 wherein the ball cartridge further comprises a magnet pack secured to the top end of the ball chase and an external follower sleeve that slides over an exterior of the cylinder in alignment with the magnet pack as the ball chase moves within the ball cartridge.

10. The ball injector as claimed in claim 9 further comprising a system that displays a relative position of the ball chase within the ball cartridge.

11. A ball injector assembly, comprising:

a cartridge section, a ball launch section, a pressure seal section, and a drive section;

a ball launcher comprising a key way that runs a full length of a bottom of the ball launcher, the key way receiving a guide key that prevents the ball launcher from rotating as it is reciprocated within a cylindrical bore that extends from an outer end of the ball launch section to an inner end of the cartridge section;

the cartridge section supporting a ball cartridge that accommodates a plurality of frac balls; and the drive section comprising a ball launcher drive comprising a cylinder having a piston with a piston rod affixed to a rear end of the ball launcher, the ball launcher drive reciprocating the ball launcher from a ball load position in which the ball chamber is located under the ball cartridge and the one of the frac balls is loaded into the ball chamber, to a ball launch position in which the ball chamber is no longer within the cartridge section so that the one of the frac balls is released through a bottom of the ball chamber.

12. The ball injector as claimed in claim 11 wherein the guide key is on a bottom of the cylindrical bore in the cartridge section and supports the frac ball in the ball chamber when the ball launcher is in the ball load position.

13. The ball injector as claimed in claim 11 further comprising longitudinal flats milled on each side of the key way to provide fluid passages that permit well stimulation fluid to flow around the ball launcher as the ball launcher is reciprocated from the ball load position to the ball launch position.

14. The ball injector assembly as claimed in claim 11 wherein the cylinder comprises a hydraulic or a pneumatic cylinder.

15. The ball injector assembly as claimed in claim 14 wherein the ball launcher drive further comprises a position indicator rod that is connected to a rear side of the piston and extends through a rear end cap of the cylinder to provide a visual indication of a location of the piston within the cylinder.

16. The ball injector assembly as claimed in claim 11 wherein the ball cartridge comprises a ball chase that urges the frac balls into the ball chamber, a top end of the ball chase being adapted to be lifted by a lifting rod to remove the ball chase from the ball cartridge and permit the ball cartridge to be recharged with frac balls.

17. The ball injector assembly as claimed in claim 11 wherein the ball cartridge comprises a cylinder of a non-magnetic material and the ball chase further comprises a magnet that strongly attracts an external follower sleeve which is slidably supported by the magnet on an outer side of the ball cartridge to provide a visual indication of a position of the ball chase within the ball cartridge.

18. The ball injector assembly as claimed in claim 11 wherein the ball chamber is a cylindrical bore that extends through the ball launcher and a top side of the ball launcher comprises a ball shunt ramp that forces any other frac balls in the ball cartridge upwardly as the ball launcher is moved from the ball load position to the ball launch position, to ensure that a frac ball resting on the frac ball in the ball chamber is not damaged as the ball launcher is moved from the ball load position to the ball launch position.

19. A ball injector adapted to be mounted to a top end of a frac head, comprising a ball injector spool having a plurality of ball injector assemblies that respectively support a ball cartridge adapted to store a plurality of frac balls, each ball injector assembly having a ball launcher reciprocated by a ball launcher drive comprising a hydraulic or pneumatic cylinder having a piston with a piston rod affixed to a rear end of the ball launcher from a ball load position in which a one of the frac balls is loaded from the ball cartridge into a ball chamber of the ball launcher and a ball launch position in which the ball chamber is within an axial passage through the ball injector spool and the one of the frac balls is released from a bottom of the ball chamber into the axial passage, the ball launcher comprising a key way that runs a full length of a bottom of the ball launcher, the key way receiving a guide key that prevents the ball launcher from rotating as it is reciprocated by the ball launcher drive.

20. The ball injector as claimed in claim 19 further comprising longitudinal flats milled on each side of the key way to provide fluid passages that permit well stimulation fluid to flow around the ball launcher as the ball launcher is reciprocated by the ball launcher drive.

* * * * *